US005353764A

United States Patent [19]

Tomisawa

[11] Patent Number: 5,353,764

[45] Date of Patent: Oct. 11, 1994

[54] ELECTRONICALLY CONTROLLED FUEL SUPPLY METHOD AND DEVICE FOR INTERNAL COMBUSTION ENGINE

[75] Inventor: Naoki Tomisawa, Isesaki, Japan

[73] Assignee: Japan Electronic Control Systems Co., Ltd., Isesaki, Japan

[21] Appl. No.: 2,849

[22] Filed: Jan. 15, 1993

[30] Foreign Application Priority Data

Jan. 16, 1992 [JP] Japan ..... 4-5846

[51] Int. Cl.[5] ..... F02D 41/06

[52] U.S. Cl. ..... 123/435; 123/436

[58] Field of Search ..... 123/435, 436

[56] References Cited

U.S. PATENT DOCUMENTS 4,706,628 11/1987 Trombley ..... 123/435 X
5,069,183 12/1991 Nagano et al. ..... 123/435 X

FOREIGN PATENT DOCUMENTS 3440 1/1985 Japan ..... 123/436
62-162364 10/1987 Japan .
63-17432 2/1988 Japan .
1-216040 8/1989 Japan .

*Primary Examiner*—Tony M. Argenbright
*Attorney, Agent, or Firm*—Foley & Lardner

[57] ABSTRACT

Based on a combustion pressure detected by a cylinder internal pressure sensor, a mean effective pressure Pi is calculated and a fluctuation amount ΔPi of the mean effective pressure Pi is calculated. The level of a predetermined frequency component of the fluctuation amount ΔPi is compared with a predetermined level. When the fluctuation amount ΔPi exceeds the predetermined value, it is judged that an increasing correction coefficient KTW according to a water temperature is smaller than a required value corresponding to a used fuel, and the increasing correction coefficient KTW is increasingly modified. When the above fluctuation amount ΔPi is less than the predetermined value, it is judged that the increasing correction coefficient KTW is larger than the required value corresponding to the used fuel, and the increasing correction coefficient KTW is decreasingly modified. Therefore, the increasing correction coefficient KTW according to the water temperature is optimized corresponding to the fuel being used.

10 Claims, 4 Drawing Sheets

ELECTRONICALLY CONTROLLED FUEL SUPPLY METHOD AND DEVICE FOR INTERNAL COMBUSTION ENGINE

BACKGROUND OF THE INVENTION

1. Field of the Invention

The present invention relates to an electronically controlled fuel supply method and a device for an internal combustion engine and particularly to a technique for optimizing a correction proportion of increasing correction of a fuel supply amount to an engine during cooling down according to properties of the used fuel.

2. Related Art of the Invention

In a conventional electronically controlled fuel supply device for an internal combustion engine, an air amount sucked into an engine is detected and a fuel supply amount according to this air amount sucked into the engine is calculated, while a fuel injection valve is driven and controlled according to this calculated fuel supply amount.

During cooling down, much of the fuel injected from the fuel injection valve adheres to the neighborhood of an intake valve, which decreases the fuel amount actually taken into a cylinder and makes the air/fuel ratio lean. Therefore, leaning of the air/fuel ratio during cooling down is prevented by increasingly correcting the fuel supply amount according to a cooling water temperature, representing the temperature of the engine, (See the Japanese Unexamined Utility Model Publication No. 62-162364).

The adhesion rate, the rate of fuel which adheres to the neighborhood of the intake valve, and the evaporation rate, the rate of the adhering fuel which evaporates and is taken into the cylinder, are different according to the properties of the fuel used at that time (especially the easiness of evaporation) even in the same temperature condition.

Therefore, in conventional examples, even when the fuel which is the hardest to evaporate was used, allowance was made and the proportion of the fuel increasing proportion according to the above mentioned water temperature was set larger so that leaning of the air/fuel ratio during cooling down which led to misfire or surge with the misfire should not occur.

Thus, when the fuel which is relatively easy to evaporate was used, the above fuel increasing correction became excessive and the air/fuel ratio was made overrich, which deteriorated fuel consumption and exhaust properties.

As a technique to compensate such nonconformance of the increasing correction due to difference in the used fuel, such a system was proposed that a sensor for detecting the fuel properties is provided and the increasing correction proportion according to the water temperature is optimized in conformance with the fuel properties detected by the above sensor (See the Japanese Unexamined Patent Publication No. 1-216040). However, as the above sensor for detecting the fuel properties is expensive, costs of the system were raised.

SUMMARY OF THE INVENTION

The present invention was made in view of the aforementioned problems, and the object of the present invention is to optimize the increasing correction amount of fuel according to the engine temperature in conformance with the properties of the used fuel so that deterioration of fuel consumption and exhaust properties due to overcorrection is avoided.

Another object of the present invention is to execute a modification to make the increasing correction amount of the fuel according to the engine temperature conform to the used fuel without directly detecting the properties of the fuel.

Still another object of the present invention is to avoid occurrence of surge which gives uncomfortableness to passengers of the vehicle on which the engine is mounted.

Also, still another object of the present invention is to carry out modification of the increasing correction amount of the fuel while avoiding occurrence of output fluctuation above a permissible level with good response and stability.

In order to achieve the above objects, according to an electronically controlled fuel supply method and a device for an internal combustion engine of the present invention, it is so constituted that, when a fuel supply amount is to be increasingly corrected based on a detected value of an engine temperature, a fluctuation level of an engine output is detected and the above increasing correction amount is modified to be a minimum value so that the fluctuation level of the engine output falls within a permissible range.

When the increasing correction amount according to the engine temperature runs short, the air/fuel ratio becomes lean and a fluctuation in engine output occurs due to lean misfire. Thus, when the above output fluctuation is at the permissible level, it can be judged that the above increasing correction amount can be decreased, and when output fluctuation above the permissible level occurs, it can be judged that the increasing correction amount has to be further increased. And the increasing correction amount as modified is the amount matching the properties of the fuel used at that time.

The above fluctuation level of the engine output can be acquired as a fluctuation in a mean effective pressure calculated based on a combustion pressure of the engine.

That is, when combustion becomes unstable due to shortage of the fuel increasing correction amount, this is detected as a fluctuation in the mean effective pressure, and it is so constituted that the combustion pressure is detected and the mean effective pressure is calculated based on the above combustion pressure so that the shortage state of the increasing correction amount can be detected.

Also, the above fluctuation level of the engine output can be detected as a fluctuation of an engine revolution cycle.

That is, when combustion becomes unstable due to shortage of the fuel increasing correction amount, this is detected as a fluctuation in the revolution cycle, and it is so constituted that the unstableness of combustion due to shortage of increasing correction can be detected by increase in the fluctuation in the revolution cycle.

Moreover, it is advantageous that a predetermined frequency component of the engine output fluctuation is extracted in detecting the fluctuation level of the engine output.

As the output fluctuation due to shortage of the fuel increasing correction amount gives uncomfortableness to the passengers in the vehicle, when the output fluctuation frequency zone is extracted, the increasing correction amount can be made as small as possible within a range which does not give uncomfortableness to the passengers.

Also, it is so constituted that the modification amount for increase is made larger than the modification amount for decreasing the increasing correction amount in modifying the increasing correction amount.

With the above constitution, when the engine output fluctuation becomes larger than the permissible level and the increasing correction amount has to be increasingly modified, the increasing modification is made with a relatively larger modification amount, which rapidly solves the engine output fluctuation. On the other hand, when the engine output fluctuation level is within the permissible range and the increasing correction amount can be made smaller, the increasing correction amount is reduced little by little with a relatively smaller modification amount so that the increasing correction amount can be made as small as possible within the range that the engine output fluctuation does not exceed the permissible level.

Other objects and aspects of the present invention will be made clear in the following explanation of the preferred embodiments by referring to the attached drawings.

PREFERRED EMBODIMENTS

Figure 1:
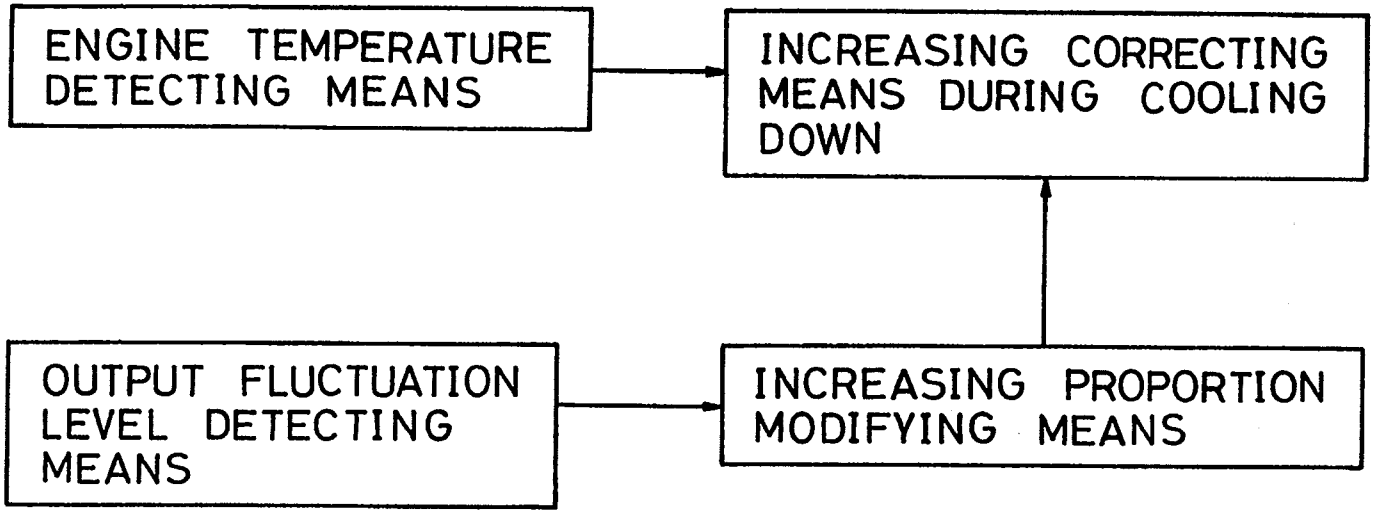
FIG. 1 is a block diagram showing the basic constitution of an electronically controlled fuel supply device for an internal combustion engine according to the present invention.

Preferred embodiments of an electronically controlled fuel supply method and a device for an internal combustion engine according to the present invention will be hereinafter described based on FIGS. 2 to 4. The basic constitution of the electronically controlled fuel supply device according to the present invention is shown in FIG. 1.

Figure 2:
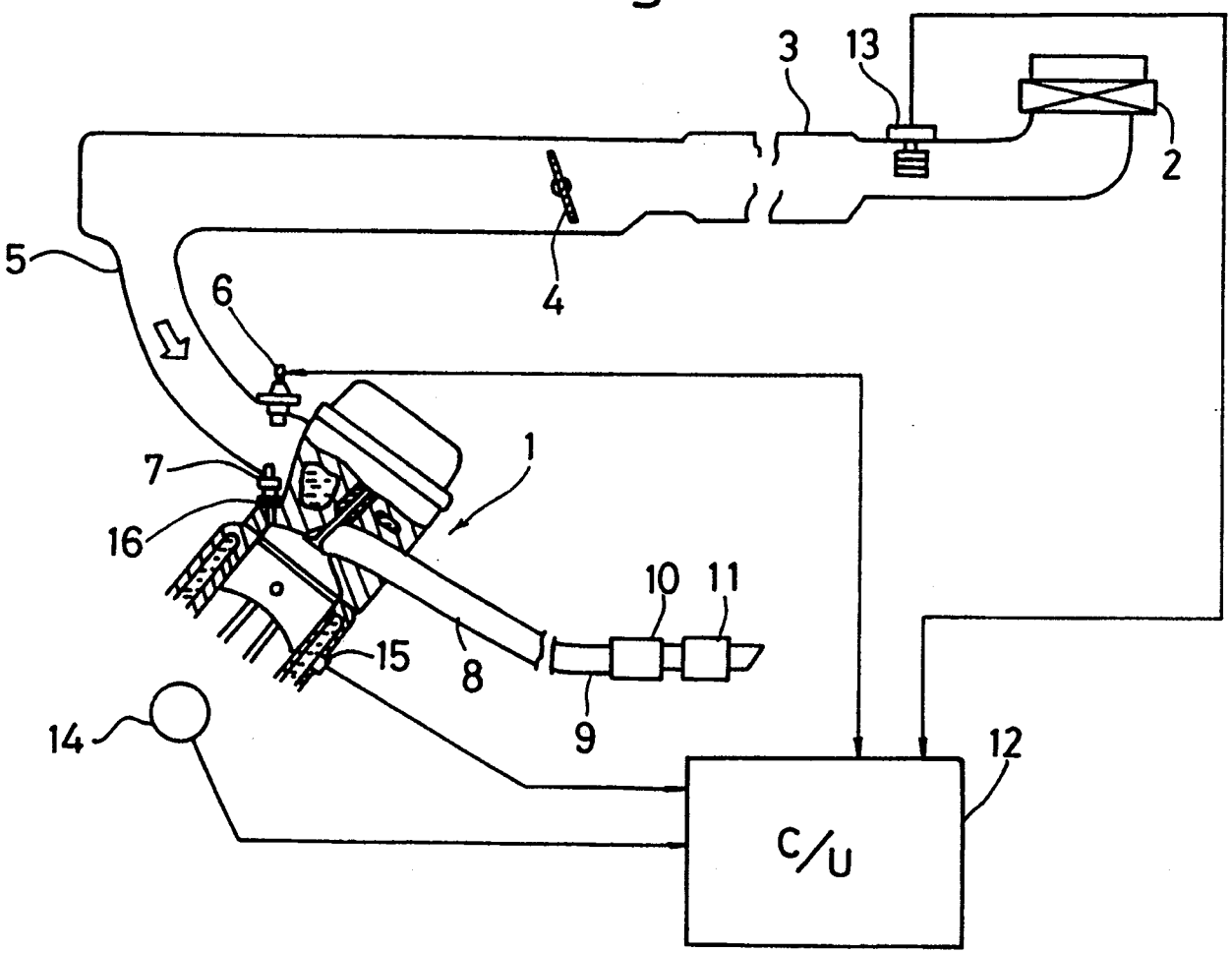
FIG. 2 is a schematic system diagram showing the system constitution of a preferred embodiment of the present invention.

In FIG. 2 showing the system constitution of a preferred embodiment, air is sucked into an internal combustion engine 1 from an air cleaner 2 through an intake duct 3, a throttle valve 4 and an intake manifold 5.

At each of branch parts of the intake manifold 5, a fuel injection valve 6 is provided for each cylinder. This fuel injection valve 6 is an electromagnetic fuel injection valve which is opened when electricity flows through a solenoid and closed when electric is stopped, and is opened by electricity control by a driving pulse signal from a control unit 12, which will be described later, and intermittently injects and supplies fuel to the engine 1 which is press fed from a fuel pump, not shown, and is regulated to a predetermined pressure by a pressure regulator.

An ignition plug 7 is provided at each of the combustion chambers of the engine 1 for spark ignition and combustion of air-fuel mixture. Exhaust gas is exhausted from the engine I through an exhaust manifold 8, an exhaust duct 9, an catalyzer 10 and a muffler 11.

The control unit 12 provided for electronic control of fuel supply to the engine has a micro computer consisting of CPU, ROM, RAM and A/D converter, an input/output interface, etc., receives input signals from various sensors, carries out processing as will be described later, and controls action of the fuel injection valve 6.

As one of the above various sensors, an air flow meter 13 is provided in the intake duct 3 for putting out a signal according to an intake air flow rate Q of the engine 1.

Also, a crank angle sensor 14 is provided for putting out a reference angle signal REF per reference angle position (per TDC, for example) and a unit angle signal POS per 1° or 2°. Here, by measuring a cycle of the above reference angle signal REF or the number of occurrences of the above unit angle signal POS in a predetermined time, an engine revolution speed Ne can be calculated.

Also, a water temperature sensor 15 is provided for detecting a cooling water temperature Tw of a water jacket of the engine 1. The above cooling water temperature Tw is a parameter representing the engine temperature, and the above water temperature sensor 15 corresponds to an engine temperature detecting means in this preferred embodiment.

Moreover, at each of the above ignition plugs 7, a cylinder internal pressure sensor (combustion pressure sensor) 16 of a type to be attached as a washer for the ignition plug 7 as disclosed in the Japanese Unexamined Utility Model Publication No. 63-17432 is provided for detecting the cylinder internal pressure of each of the cylinders. The above cylinder internal pressure sensor 16 can be such a type that directly faces its sensor part into the combustion chamber for detecting the cylinder internal pressure as an absolute pressure other than the type to be attached as the washer of the ignition plug 7 as mentioned above.

Figure 3:
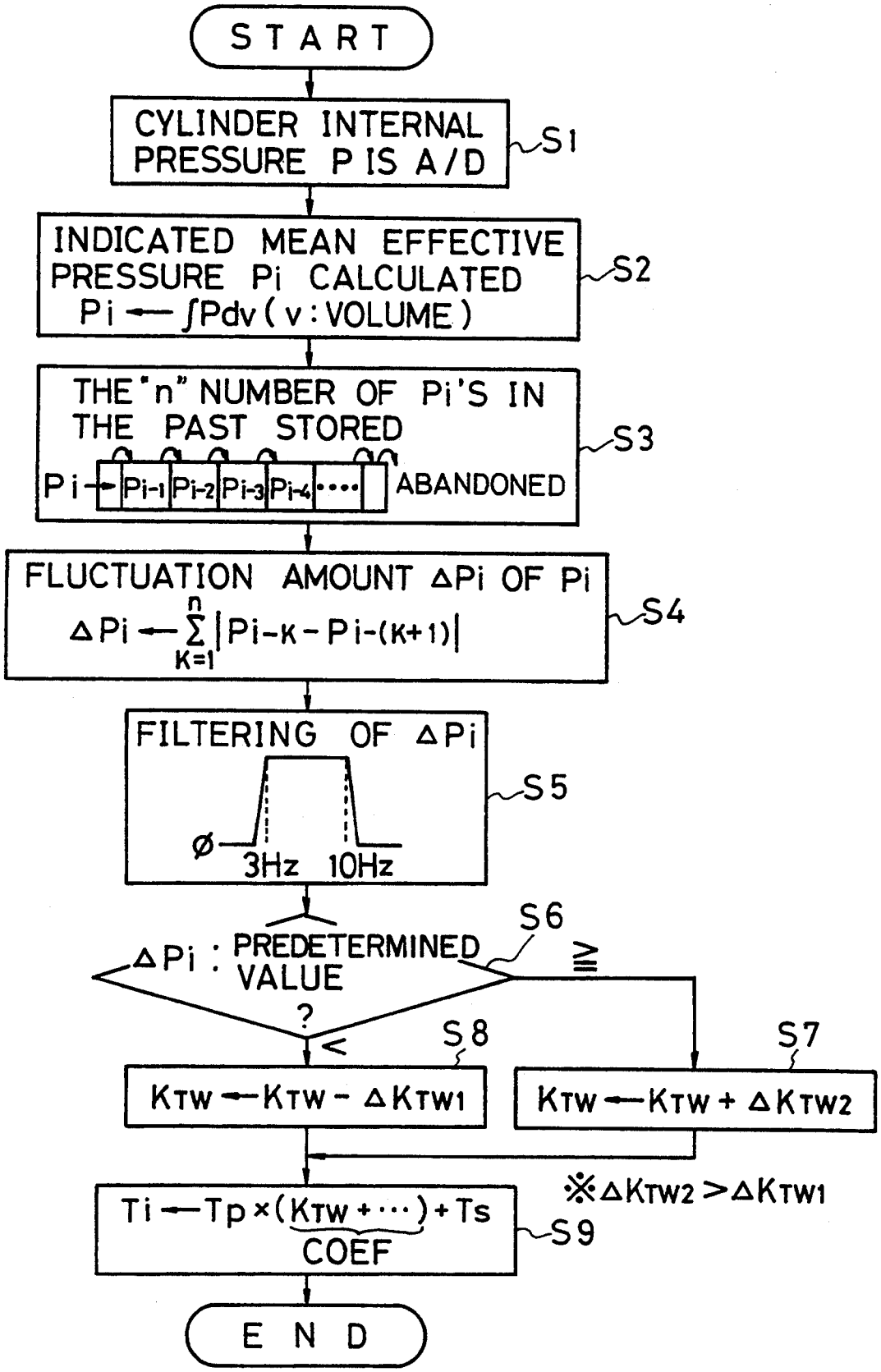
FIG. 3 is a flowchart showing a first preferred embodiment of modification control of a fuel increasing correction amount.

Here, the CPU of the micro computer built in the control unit 12 carries out processing according to the program on the ROM shown in the flowchart of FIG. 3, calculates a fuel injection amount (fuel supply amount) Ti to the engine 1 and puts out a driving pulse signal of the pulse width corresponding to the above fuel injection amount Ti to the fuel injection valve 6 with a predetermined injection timing.

In this preferred embodiment, the control unit 12 is provided with the functions of the output fluctuation level detecting means, an increasing proportion modifying means and an increasing correction means during cooling down ( See FIG. 1) in the software manner, and the above output fluctuation level detecting means (See FIG. 1) is realized by the software function of the control unit 12 and the cylinder internal pressure sensor 16.

In the program shown in the flowchart of FIG. 3, first, at Step 1 (S1 in FIGS. The same applies to the remainder), a detection signal put out of the cylinder internal pressure sensor 16 according to a cylinder internal pressure (combustion pressure) P is A/D converted and read each time when the unit angle sensor POS is put out of the crank angle sensor 14.

And at Step 2 (mean effective pressure calculating means), an indicated mean effective pressure Pi per cycle of the engine ($=\int PDV$; V is a cylinder volume) is calculated based on the cylinder internal pressure P as read.

At the next Step 3, data of the indicated mean effective pressure Pi calculated per cycle as mentioned above is updated and stored for the latest value and the "n"th value in the past. At Step 4 (mean effective pressure fluctuation calculating means), an absolute value of a deviation between adjoining data of the indicated mean effective pressure Pi stored in the time series is integrated and this integrated value is set at ΔPi as a fluctuation amount of the indicated mean effective pressure Pi.

At Step 5 (predetermined frequency component extracting means), a filtering processing is given to extract only a specific frequency component (3 Hz to 10 Hz) of the above fluctuation amount ΔPi (value in proportion to the fluctuation amount of engine output torque), and at Step 6, the above extracted value of the fluctuation amount ΔPi is compared with a predetermined value.

Here, the above specific frequency component is a frequency zone corresponding to a main component of torsional vibration of a vehicle driving system generated by a fluctuation of the indicated mean effective pressure Pi, and this frequency zone overlaps with the frequency zone which the passengers in the vehicle feel most sensitively. Thus, when the level of this specific frequency component is less than a predetermined level, it does not give uncomfortableness of surge to the passengers and the above predetermined level is the value corresponding to a permissible limit of the surge.

When, at Step 6, it is judged the the fluctuation amount ΔPi of the indicated mean effective pressure Pi is more than the predetermined value, it is assumed that the indicated mean effective pressure Pi is largely fluctuated by occurrence of misfire due to leaning and that the passengers are given uncomfortableness caused by occurrence of surge. Then the program goes on to Step 7, and an increasing correction coefficient KTW according to the present cooling water temperature Tw is increasingly modified by a predetermined value ΔKTW2 (modified in the direction to further increase the fuel injection amount), and the increasing correction coefficient KTW as increasingly modified is made as data corresponding to the present cooling water temperature Tw and a map of the increasing correction coefficient KTW set according to the cooling water temperature Tw is rewritten.

In the meantime, when it is judged at Step 6 that the fluctuation amount ΔPi of the indicated mean effective pressure Pi is less than the predetermined value, the program goes to Step 8, wherein the increasing correction coefficient KTW corresponding to the present cooling water temperature Tw is decreasingly modified (modified in the direction to decrease the fuel injection amount) by the predetermined value ΔKTW1, and the increasing correction coefficient KTW as decreasingly modified is made as data corresponding to the present cooling water temperature Tw and the map of the increasing correction coefficient KTW set according to the cooling water temperature Tw is rewritten.

The above increasing correction coefficient KTW is set during cooling down when the proportion of the wall flow adhering to the neighborhood of the intake valve among the fuel injected from the fuel injection valve 6 is a maximum so that leaning of the air/fuel ratio caused by increase in the above wall flow is prevented. However, when the properties of the used fuel such as easiness of evaporation is changed, the above adhesion rate (and evaporation rate from the wall flow) is changed, whereby the required increasing correction amount is changed.

Here, when the increasing correction is made less than the required amount, misfire will occur due to leaning of the air/fuel ratio, which would incur occurrence of surge, while in the case where the increasing correction is excessively made against the required amount, even though surge will not occur, fuel consumption and exhaust properties will be impaired by useless increase.

Then, in this preferred embodiment, occurrence of surge due to shortage of increasing correction according to water temperature is detected based on the above Pi indicating the fluctuation level of the engine output, and the increasing correction coefficient KTW corresponding to the water temperature at that time is modified so that the above Pi gets close to the predetermined value, in other words, the surge level gets close to the permissible level. By this, occurrence of surge exceeding the permissible level can be surely avoided corresponding to change in the required increasing proportion, which is different depending on the used fuel, without making useless increase. Moreover, as the cylinder internal pressure sensor 16 provided for detecting misfire, knocking, etc. can be used to optimize the increasing correction coefficient KTW, there is no need to provide a fuel properties sensor to optimize the increasing correction coefficient KTW according to change of the used fuel, whereby drastic rise in cost can be avoided.

The predetermined values ΔKTW1 and ΔKTW2 (modification amount) used for modifying the increasing correction coefficient KTW as mentioned above are in the relation of $\Delta KTW1 < \Delta KTW2$. By this, occurrence of surge due to shortage of increasing correction can be rapidly avoided by increasing the correction coefficient KTW by a large step, and the increasing correction proportion can be brought close to the required minimum by gradually decreasing the correction coefficient KTW by a small step when surge less than the permissible level occurs.

Here, it can be so constituted that, when the fluctuation amount ΔPi exceeds the predetermined value after gradually decreasing the correction coefficient KTW, the correction coefficient KTW level immediately before the fluctuation amount Pi exceeds the predetermined level is learned and the learned result is continuously used until the used fuel is switched (driving of the engine is stopped).

The increasing correction coefficient KTW modified as above is used in setting the fuel injection amount Ti at Step 9. Specifically, a primary fuel injection amount Tp is calculated based on the intake air flow rate Q detected at the air flow meter 13 and the engine revolution speed Ne calculated based on the detection signal from the crank angle sensor 14 (←K x Q/Ne: K is a constant), while various correction coefficients COEF including the above increasing correction coefficient KTW (=KTW+. . .) are set and moreover, a correction amount Ts for correcting change in effective valve-opening time of the fuel injection valve 6 by battery voltage is set. The above primary fuel injection amount Tp is corrected by the above various correction coefficients COEF and the voltage correction amount Ts to calculate the final fuel injection amount Ti (=Tp×COEF+Ts).

In the above preferred embodiment, though the fluctuation level of the engine output is captured as a change in the indicated mean effective pressure Pi acquired based on the cylinder internal pressure (combustion pressure) P, the fluctuation level of the engine output can be also captured based on the revolution fluctuation of the engine.

Particularly, even when the cylinder internal pressure sensor 16 in the above preferred embodiment is not provided, the crank angle sensor 14 is a sensor generally provided to obtain information on the engine revolution speed, indispensable for electronic control of fuel injection, and the constitution wherein the engine output fluctuation is detected based on revolution fluctuation gives more generality to control.

A second preferred embodiment wherein the output fluctuation level is detected based on such revolution fluctuation to modify the increasing correction coefficient KTW according to the water temperature will be hereinafter described according to the flowchart in FIG. 4.

Figure 4:
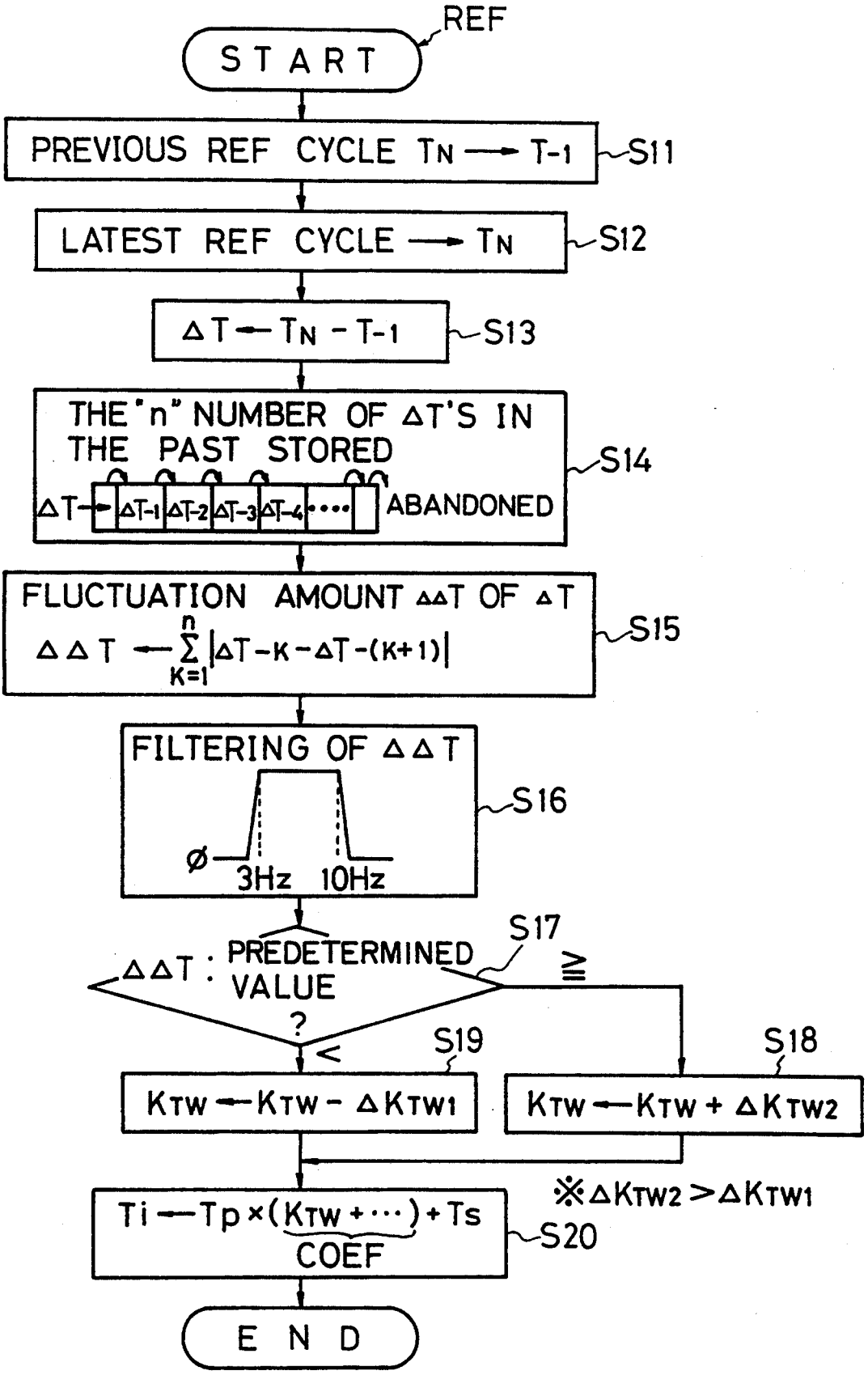
FIG. 4 is a flowchart showing a second preferred embodiment of modification control of a fuel increasing correction amount.

Here, too, the control unit 12 is provided with, as shown in the flowchart in FIG. 4, the functions of the output fluctuation level detecting means, the increasing proportion modifying means, and the increasing correcting means during cooling down (See FIG. 1) in the software manner, and the above output fluctuation level detecting means (See FIG. 1) is realized by the software function of the control unit 12 and the crank angle sensor 14.

The flowchart in FIG. 4 is executed each time when the reference angle signal REF per TDC is put out of the crank angle sensor 14, and first, at Step 11, the latest TDC cycle Tn obtained at the last execution of this program is set at T-1 as a previous value.

At the next Step 12 (revolution cycle measuring means), the latest value of the TDC cycle (revolution cycle) acquired as the time from when the previous reference angle signal REF is put out till the current reference signal REF is put out is set at TN.

And at step 13, the previous TDC cycle T-1 is subtracted from the latest TDC cycle TN to calculate a change amount T of the TDC cycle.

At Step 14, the data of the change amount $\Delta T$ acquired per reference angle signal REF as mentioned above is updated and stored for the latest value and the "n"th value in the past.

At Step 15 (revolution cycle fluctuation calculating means), an absolute value of a deviation between adjoining data of the cycle change amount $\Delta T$ stored in the time series is integrated and this integrated value is set at a fluctuation amount $\Delta\Delta T$ of the cycle change amount $\Delta T$.

At Step 16 (predetermined frequency component extracting means), a filtering processing is given in order to extract only a component of a frequency zone corresponding to the frequency zone felt by the passengers (3 Hz to 10 Hz, for example) among the frequency components of the above fluctuation amount $\Delta\Delta T$.

At Step 17, the above specific frequency component extracted from the above fluctuation amount $\Delta\Delta T$ is compared with the predetermined value corresponding to the permissible level of surge to judge shortage or excess of the increasing correction coefficient KTW according to the water temperature used at the present.

Similarly with the above preferred embodiment, when the fluctuation amount $\Delta$, $\Delta T$ is more than the predetermined value, it is judged the the air/fuel ratio becomes lean due to shortage of the increasing proportion by the increasing correction coefficient KTW and the surge exceeding the permissible level occurs, and the increasing correction coefficient KTW is increased by the predetermined value $\Delta KTW2$ to increase the fuel (Step 18).

Contrarily, when the fluctuation amount $\Delta\Delta T$ is less than the predetermined value, it is judged that there is a probability to further decrease the increasing proportion by the increasing correction coefficient KTW while avoiding occurrence of surge, and the increasing correction coefficient KTW is decreased by the predetermined value $\Delta KTW1$ ($<\Delta KTW2$) to decrease the fuel (Step 19).

At step 20, as in Step 9 in the flowchart in FIG. 3, the primary fuel injection amount Tp is corrected using the various correction coefficients COEF set including the above increasing correction coefficients KTW to set the final fuel injection amount Ti.

I claim:

1. An electronically controlled fuel supply method for an internal combustion engine comprising: the steps of detecting an engine temperature;

increasingly correcting a fuel supply amount to the engine according to said detected engine temperature;

detecting a fluctuation level of an engine output; and modifying an increasing correction amount of fuel according to said engine temperature to a minimum value so that the fluctuation level of the engine output falls within a permissible range, based on said detected fluctuation level of the engine output.

2. An electronically controlled fuel supply method for an internal combustion engine according to claim 1, wherein said step for detecting the fluctuation level of the engine output comprises:

detecting a combustion pressure of the engine:

calculating a mean effective pressure based on said detected combustion pressure; and calculating a fluctuation of said calculated mean effective pressure.

3. An electronically controlled fuel supply method for an internal combustion engine according to claim 1, wherein said step for detecting the fluctuation level of the engine output comprises;

measuring a revolution cycle of the engine; and calculating a fluctuation of said measured revolution cycle.

4. An electronically controlled fuel supply method for an internal combustion engine according to claim 1, wherein said step for detecting the fluctuation level of the engine output comprises extracting a predetermined frequency component of the engine output fluctuation.

5. An electronically controlled fuel supply method for an internal combustion engine according to claim 1, wherein said step for modifying the increasing correction amount carries out modification of the increasing correction amount with a modification amount for increasing larger than the modification amount for decreasing the increasing correction amount.

6. An electronically controlled fuel supply device for an internal combustion engine comprising:

an engine temperature detecting means for detecting an engine temperature;

an increasing correcting means during cooling down for increasingly correcting a fuel supply amount to the engine according to the engine temperature detected by said engine temperature detecting means;

an output fluctuation level detecting means for detecting a fluctuation level of an engine output; and an increasing proportion modifying means for modifying an increasing correction amount of said increasing correcting means during cooling down so that the fluctuation level of the engine output detected by said output fluctuation level detecting means gets close to a predetermined level.

7. An electronically controlled fuel supply device for an internal combustion engine according to claim 6, wherein said output fluctuation level detecting means comprises:

a cylinder internal pressure sensor for detecting a combustion pressure of the engine;

a mean effective pressure calculating means for calculating a mean effective pressure based on the combustion pressure detected by said cylinder internal pressure sensor; and a mean effective pressure fluctuation calculating means for calculating a fluctuation of the mean effective pressure calculated by said mean effective pressure calculating means.

8. An electronically controlled fuel supply device for an internal combustion engine according to claim 6, wherein said output fluctuation level detecting means comprises:

a revolution cycle measuring means for measuring a revolution cycle of the engine; and a revolution cycle fluctuation calculating means for calculating a fluctuation of the revolution cycle measured by said revolution cycle measuring means.

9. An electronically controlled fuel supply device for an internal combustion engine according to claim 6, wherein said output fluctuation level detecting means comprises a predetermined frequency component extracting means for extracting a predetermined frequency component of the engine output fluctuation.

10. An electronically controlled fuel supply device for an internal combustion engine according to claim 6, wherein said increasing proportion modifying means carries out modification of the increasing correction amount with a modification amount for increasing larger than the modification amount for decreasing the increasing correction amount.

* * * * *